US008708183B2

(12) United States Patent
Burke

(10) Patent No.: US 8,708,183 B2
(45) Date of Patent: Apr. 29, 2014

(54) LID-LIFT HOLE LINER AND CONTAINMENT BOX FOR UTILITY VAULT LIDS

(75) Inventor: Edward J. Burke, Temecula, CA (US)

(73) Assignee: Channell Commercial Corporation, Temecula, CA (US)

( * ) Notice: Subject to any disclaimer, the term of this patent is extended or adjusted under 35 U.S.C. 154(b) by 13 days.

(21) Appl. No.: 13/468,996

(22) Filed: May 10, 2012

(65) Prior Publication Data

US 2012/0285105 A1 Nov. 15, 2012

Related U.S. Application Data

(60) Provisional application No. 61/484,601, filed on May 10, 2011.

(51) Int. Cl.
*B65D 45/00* (2006.01)
*B65D 90/22* (2006.01)

(52) U.S. Cl.
USPC ..... 220/328; 220/327; 220/694; 454/48; 52/124.1; 52/124.2

(58) Field of Classification Search
USPC ..... 220/254.1, 327, 328, 495.01, 567.2, 220/694, 702, 890; 454/48; 52/124.1, 124.2
See application file for complete search history.

(56) References Cited

U.S. PATENT DOCUMENTS

| | | | | |
|---|---|---|---|---|
| 3,289,556 | A | 12/1966 | Russell | |
| 4,726,707 | A | 2/1988 | Newton | |
| 5,230,583 | A | 7/1993 | Johnson | |
| 5,312,295 | A | 5/1994 | Young | |
| 6,202,985 | B1 | 3/2001 | Chong et al. | |
| 6,743,088 | B2 | 6/2004 | Closkey | |
| 7,883,290 | B1 * | 2/2011 | Ross et al. | 404/25 |
| 2008/0016780 | A1 | 1/2008 | McDougle et al. | |
| 2010/0329782 | A1 | 12/2010 | Miller et al. | |
| 2011/0084086 | A1 | 4/2011 | Rost et al. | |

FOREIGN PATENT DOCUMENTS

| | | |
|---|---|---|
| JP | 50-020196 | 3/1975 |
| JP | 56-71853 | 6/1981 |
| JP | 61-125558 | 8/1986 |
| JP | 2004-100178 | 4/2004 |
| JP | 2011-058276 | 3/2011 |

OTHER PUBLICATIONS

International Search Report for International Application No. PCT/US2012/037383, mailed on Oct. 17, 2012, 5 pages.

* cited by examiner

*Primary Examiner* — Anthony Stashick
*Assistant Examiner* — Madison L Poos
(74) *Attorney, Agent, or Firm* — Christie, Parker & Hale, LLP

(57) ABSTRACT

A lid-lift hole assembly for an underground utility vault lid comprises a liner positioned in an open-ended lid-lift hole, and a receptacle positioned below the liner. Opposite side walls of the receptacle contain thru-holes aligned with fastener holes in opposite side walls of the liner, Fasteners extending through the thru-holes and into the fastener holes (from the underside of the lid) are tightened (to apply pressure to the juncture between the receptacle and the liner) to lock the liner in the lid-lift hole. The receptacle forms an enlarged-volume, box-like enclosure rigidly (but releasably) held beneath an open passage through the liner. The space inside the receptacle can contain debris kept from entering the working area of the vault. The space inside the receptacle is shaped to receive a tool for removing the lid.

9 Claims, 8 Drawing Sheets

19
14
10
18
34
16
36
31
32
12
28
24
37
37
22
32
26
24
31
30
30

LID-LIFT HOLE LINER AND CONTAINMENT BOX FOR UTILITY VAULT LIDS

CROSS-REFERENCE TO RELATED APPLICATION

This application claims priority to U.S. Provisional Application No. 61/484,601, filed May 10, 2011, the entire disclosure of which is incorporated herein by this reference.

FIELD OF THE INVENTION

This invention relates to vaults with open lid-lift holes in their lids or covers, such as the underground or grade level utility vaults used in the communications industry, although the invention is also applicable to vaults used in other industries such as water and power. More particularly, the invention relates to a lid-lift liner and containment box assembly for utility vault lids.

BACKGROUND

Underground utility vaults used in the communications industry can contain optical fiber cables for broadband communications, telephone and satellite TV installations, data transmission lines, and other communication wires and cables. Utility vaults for underground utility lines often need to be opened for making repairs or for adding a service. The concrete lid on the vault often contains an open-ended lid-lift hole. The lid is opened by a tool or pick with a hook at one end. The hook is inserted through the hole and used for prying the lid away from its opening atop the vault.

However, the open lid-lift holes in such ground level vaults are often used to dispose of junk or other unwanted items. Often these disposed-of items include illicit or hazardous materials such as medical waste (syringe needles, for example). In come countries the discarding of contaminated needles into underground utility vaults by drug users has become a safety hazard to the workers in the CATV and telephone industries when they enter and work in the internal vault area. This access to such disposed-of items is prevalent in lids or covers that require a full opening to allow the approved lid or vault lifting tool to function properly, for example.

The present invention provides an improvement over to the standard lid-lift hole, in which such debris can be kept out of the underground vault region, away from workers and the service equipment. And any debris that may find its way into the lid-lift hole can be easily disposed of. At the same time the invention does not otherwise adversely affect the standard way of using a tool to lift the lid from its opening in the underground utility vault.

SUMMARY

One embodiment of the invention comprises a lid-lift hole liner and containment box assembly for lids used in utility vaults. As mentioned, the invention is applicable to vault lids or covers with open lid-lift holes, such as those used in the communications industry, but also for vaults used for water or power, for example. The liner comprises a shell having an open top and an open bottom. The liner is positioned in a lid-lift hole that passes through the utility vault lid. The liner can include an upper rim which extends around the perimeter of the liner for holding the liner in place against a top surface of the lid. The containment box comprises an upwardly opening receptacle positioned beneath the lid to face the open bottom of the liner. A top edge of the receptacle is held against the bottom surface of the utility vault lid. Opposite sides of the receptacle are formed with thru-holes aligned with downwardly opening, internally threaded holes contained in opposite end walls of the liner. Fasteners on opposite sides of the receptacle extend upwardly from beneath the lid, through the thru-holes in the receptacle, and into the threaded holes in the liner. The fasteners are tightened to apply pressure between the liner and the receptacle to lock the liner in the lid-lift hole, while the receptacle is held in a fixed position beneath the liner, compressed against the bottom of the lid, and forming a containment box secured to the bottom face of the lid. The assembly cooperates to provide a hollow upper space through the lid (inside the liner) that opens into a larger lower space inside the containment box, spaced below the underside of the lid. The space inside the box provides a lifting hole that accommodates a lid-lift hook or other tool that passes through the lid-lift hole (and the liner) and into the interior of the box. During use, the space inside the containment box can contain any debris which is otherwise kept from entering the vault.

Thus, the invention can be designed to facilitate receiving an approved lid-lifting tool, while preventing unwanted debris or other contaminated material from entering the working area of the vault. The receptacle can be easily removed from the underside of the lid to discard any debris in a controlled manner.

These and other aspects of the invention will be more fully understood by referring to the following detailed description and the accompanying drawings.

DETAILED DESCRIPTION

Figure 1:
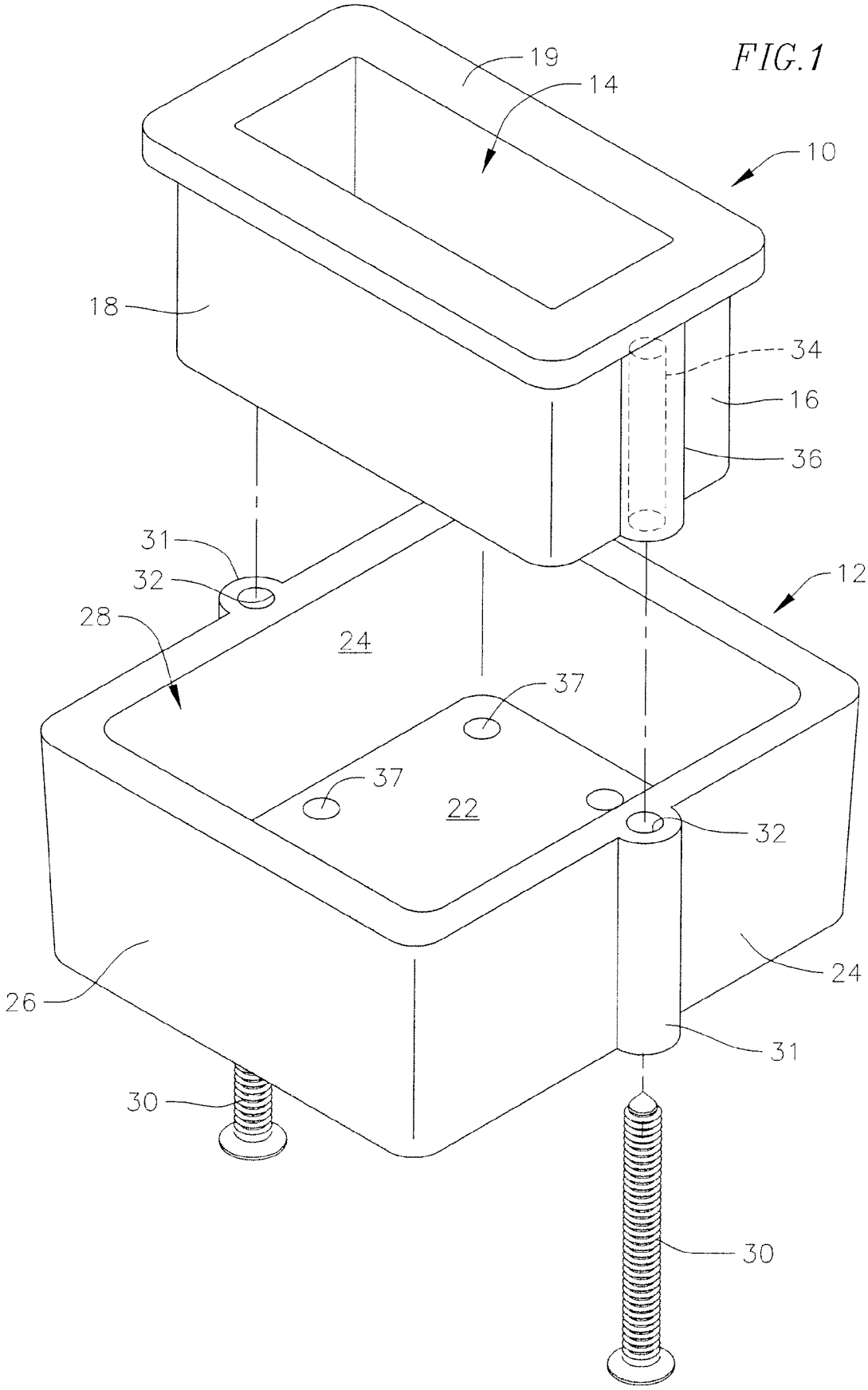
FIG. 1 is an exploded perspective view showing components of a lid-lift hole liner and containment box assembly according to one embodiment of this invention.

FIG. 1 shows a two part assembly: a lid-lift hole liner 10 and a receptacle 12. The lid-lift hole liner 10 comprises a shell which is rectangular in shape, with an open top and an open bottom, forming a hollow space 14 passing through the liner. The rectangular liner has shorter end walls 16 and longer side walls 18, although the configuration can vary. The upper edge of the liner is formed by a rectangular rim 19 projecting outwardly around the top of the opening in the liner. The liner is rectangular to fit inside (and provide a liner for) a corresponding rectangular lid-lift hole in a concrete lid 20 (shown in FIGS. 2 and 3) for an underground utility vault—the type of vault used to contain utility equipment, e.g., cable TV equipment, data transmission lines, telephone switching equipment, services lines, power transmission devices, and water meters, for example. Typically, the underground enclosures or vaults on which the lid is used are grade level boxes used for such equipment.

The receptacle 12 is generally rectangular in shape with a bottom face 22 spaced below opposite side walls 24 and end walls 26 extending upwardly around the perimeter of the bottom face 22. The receptacle, also referred to as a containment box, forms a hollow space 28 that faces upwardly toward the open space 14 that passes through the liner 10.

In use, the two components of the assembly are fastened together (as described below) with threaded fasteners 30. The opposite side walls 24 of the receptacle are each formed with molded elongated profiles 31 containing thru-holes 32 for receiving the fasteners. In use, the thru-holes are aligned with internally threaded holes 34 contained in elongated profiles 36 projecting from the end walls 16 of the liner. The bottom face 22 of the receptacle also contains spaced apart drainage holes 37 for rain water to pass through the bottom of the receptacle during use.

Figure 2:
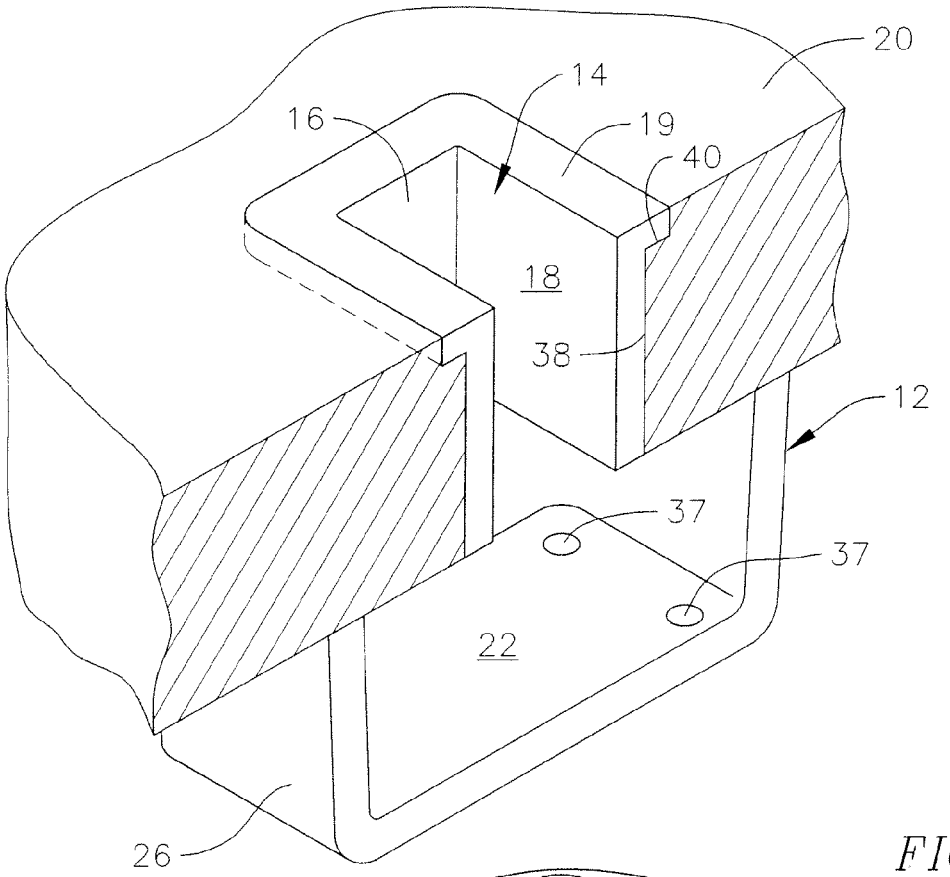
FIG. 2 and FIG. 3 comprise orthogonal cross-sectional views showing the invention in its assembled form, positioned in a concrete lid for an underground utility vault.
Figure 3:
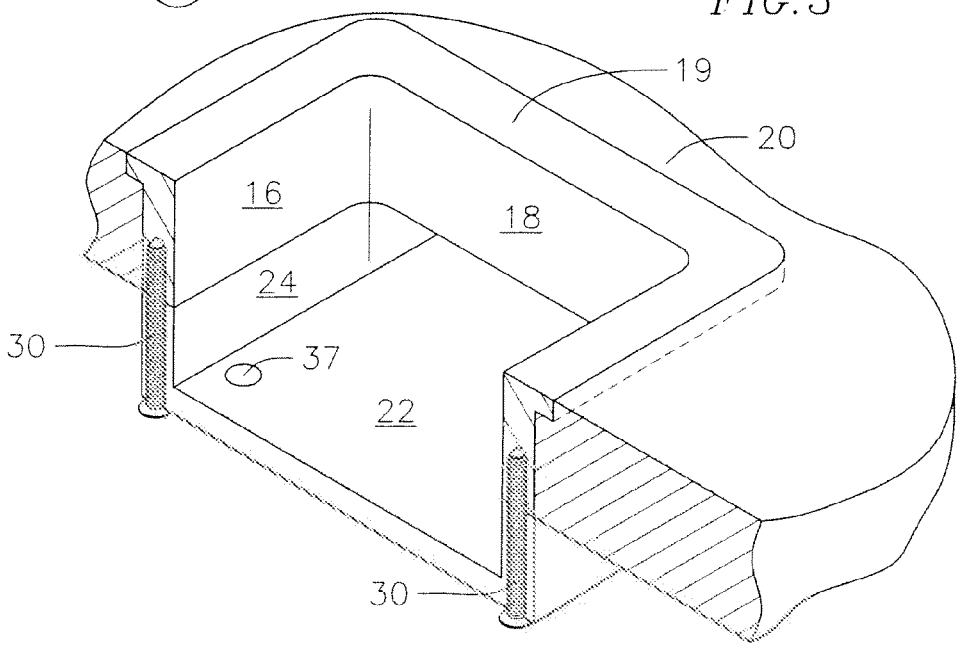

FIGS. 2 and 3 are orthogonal cross-sectional views showing the assembly in use in its assembled form contained in the lid 20 of the underground utility vault. The liner is positioned in a rectangular-shaped open-ended lid-lift hole 38 that extends through the concrete utility vault lid 20. The outer rim 19 of the liner rests on a rectangular recess 40 that spans the lid-lift hole, for rigidly positioning the liner in the hole. The receptacle 12 is positioned below the liner, on the bottom side of the lid, with the top edges of the opposite side walls 24 of the receptacle (the ones containing the thru-holes 32) abutted against the lower edge of the liner's side walls 16, so as to align the thru-holes 32 with the threaded holes 34 in the liner. During assembly, the fasteners 30, on the underside of the lid, extend up through the thru-holes 32 and into the internally threaded holes 34 in the liner. The fasteners are tightened to apply pressure between the liner and the receptacle, to lock the liner in the lid-lift hole, while the receptacle is rigidly (but releasably) held in a fixed position beneath the liner. Preferably, the tightening of the fasteners 30 applies a compression force between the receptacle and the bottom face of the lid, via the liner being held in position by the outer rim 19. This assembly forms a containment box rigidly secured to the bottom face of the lid. The assembly cooperates to provide the hollow upper space 14 through the lid (inside the liner) that opens into the larger lower space 28 inside the containment box, spaced below the underside of the lid and its liner.

The open space 28 inside the containment box accommodates a lid-lift hook or a pick, for example, that passes through the lid-lift hole and into the interior of the containment box, for use in lifting the lid from its fixed position on the vault. The lid-lift tool can be an approved or proprietary tool, and the liner and/or receptacle can be shaped and sized and/or positioned to accommodate the lid-lift tool. During use, the space inside the box also can intercept debris inserted through the hole 38, keeping it from entering the working area of the vault. The receptacle is removable from the liner by removing the fasteners, to free the receptacle from the liner, for disposing of any debris in the receptacle.

The liner and the receptacle are dimensioned so that the open space within the box is substantially greater in volume than the open space within the liner above it, to accommodate the debris that may pass through the hole 38. The box projects outerwardly (projecting away from both sides of the liner) along the underside of the lid, to form the enlarged open spaces 44 (see FIG. 4) below the lid-lift hole. The enlarged spaces are of sufficient size (in both vertical height and width) to accommodate the hook portion of a lid-lift tool that extends through the liner and into the box. The hook can extend into the enlarged area within the box, below the underside of the lid, for use in prying up with a force necessary to dislodge the lid from the vault. The oversized box also prevents removal of the assembly from outside the lid.

FIGS. 4-7 show an alternative form of the invention in which component parts of the assembly are similar.

Figure 4:
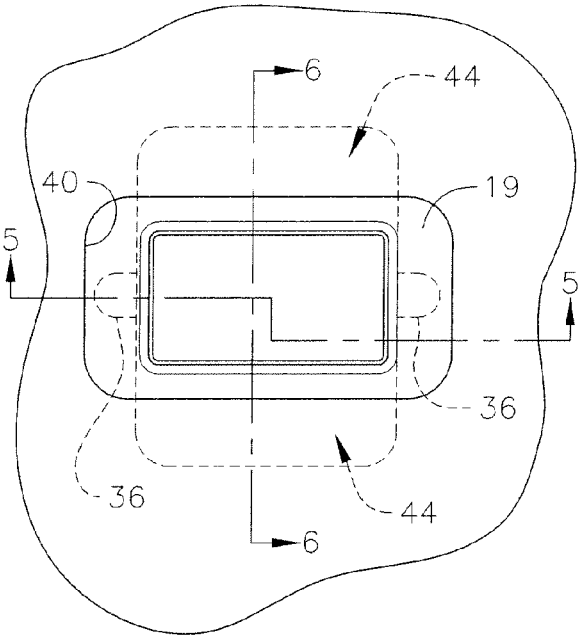
FIG. 4 is a top elevational view showing another embodiment of the invention in its assembled form.

FIG. 4 best illustrates the enlarged open areas 44 of the box that extend away from opposite sides of the lid-lift hole 38, beneath the lid.

Figure 6:
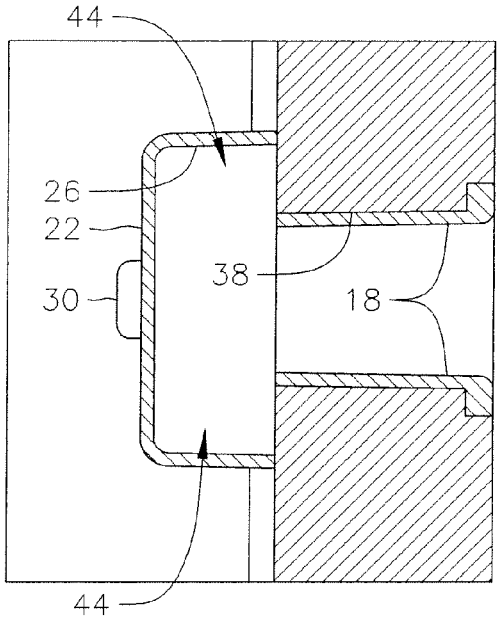
FIG. 6 is a cross-sectional view taken on line 6-6 of FIG. 4.
Figure 5:
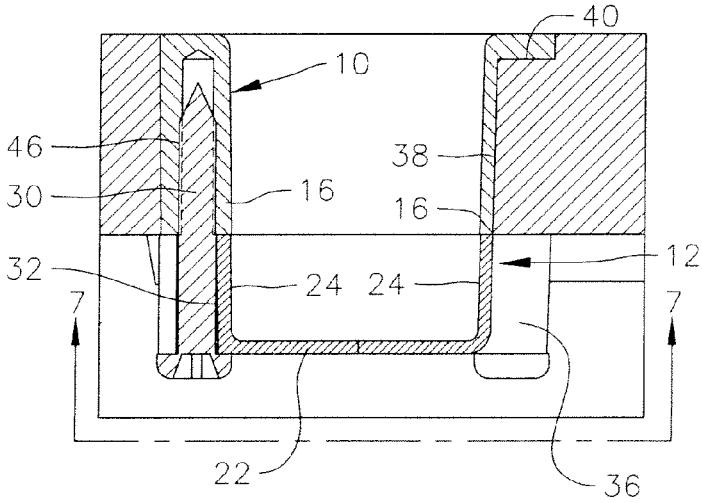
FIG. 5 is a cross-sectional view taken on line 5-5 of FIG. 4.
Figure 7:
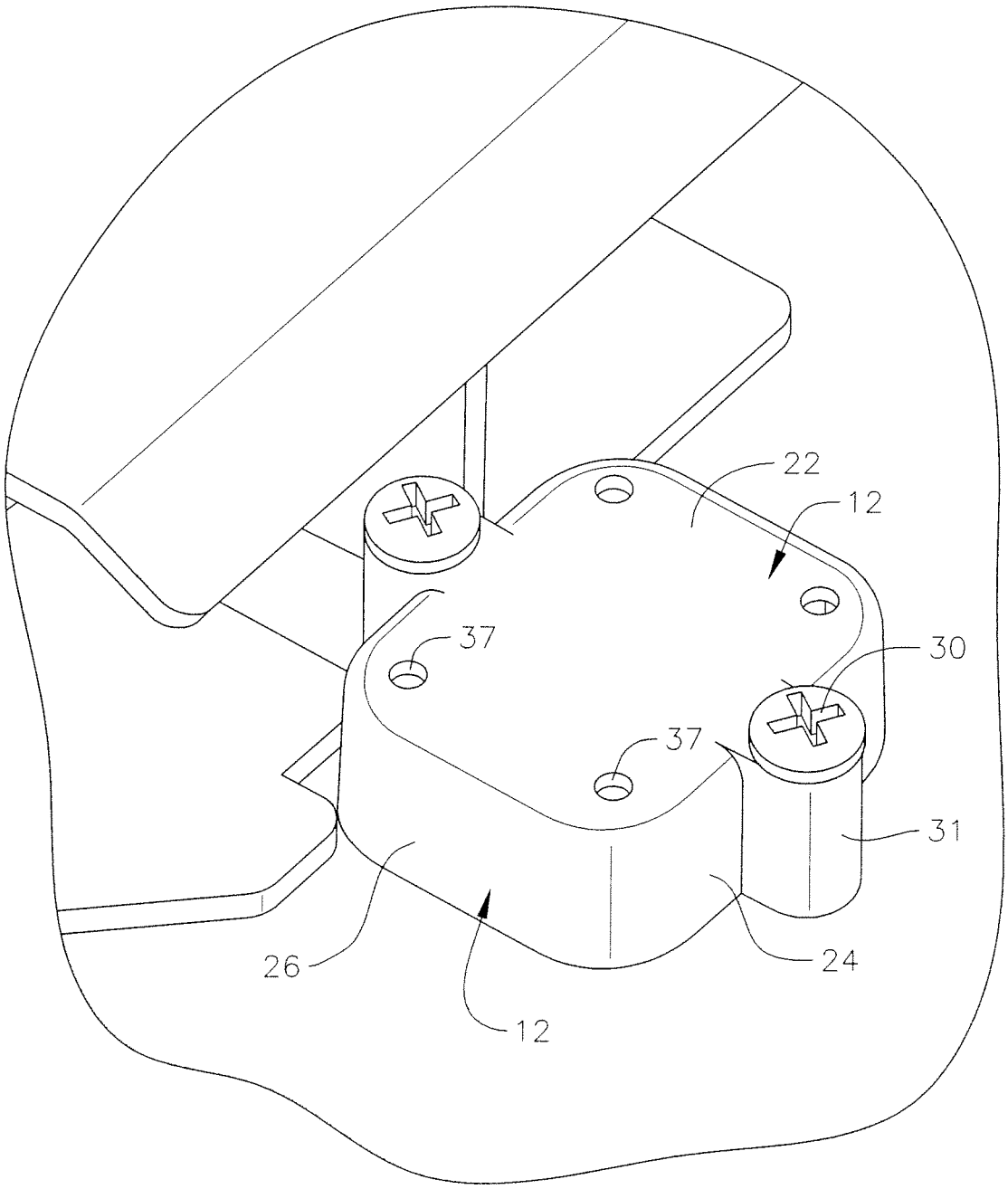
FIG. 7 is a perspective view showing the underside of the containment box, as shown in its assembled form, taken on line 7-7 of FIG. 5.

The cross-sectional views of FIGS. 5 and 6 show an alternative form of the invention in which the internally threaded holes 34 in opposite sides of the liner can be formed by a threaded insert 46, such as one made of metal, affixed to the insides of the profiles 36.

In use, the receptacle 12 can be easily removed from its fixed position to dispose of any debris contained in the receptacle. The fasteners 30 can be removed from the liner to remove the receptacle, from access such as that shown in FIG. 7.

The rectangular configurations of the liner and receptacle are examples only, as other configurations may be used. The size of the receptacle also may vary beyond that shown in the illustrated embodiments.

The liner and receptacle are made of a hard plastic material, such as polycarbonate, although other materials may be used.

Figure 8:
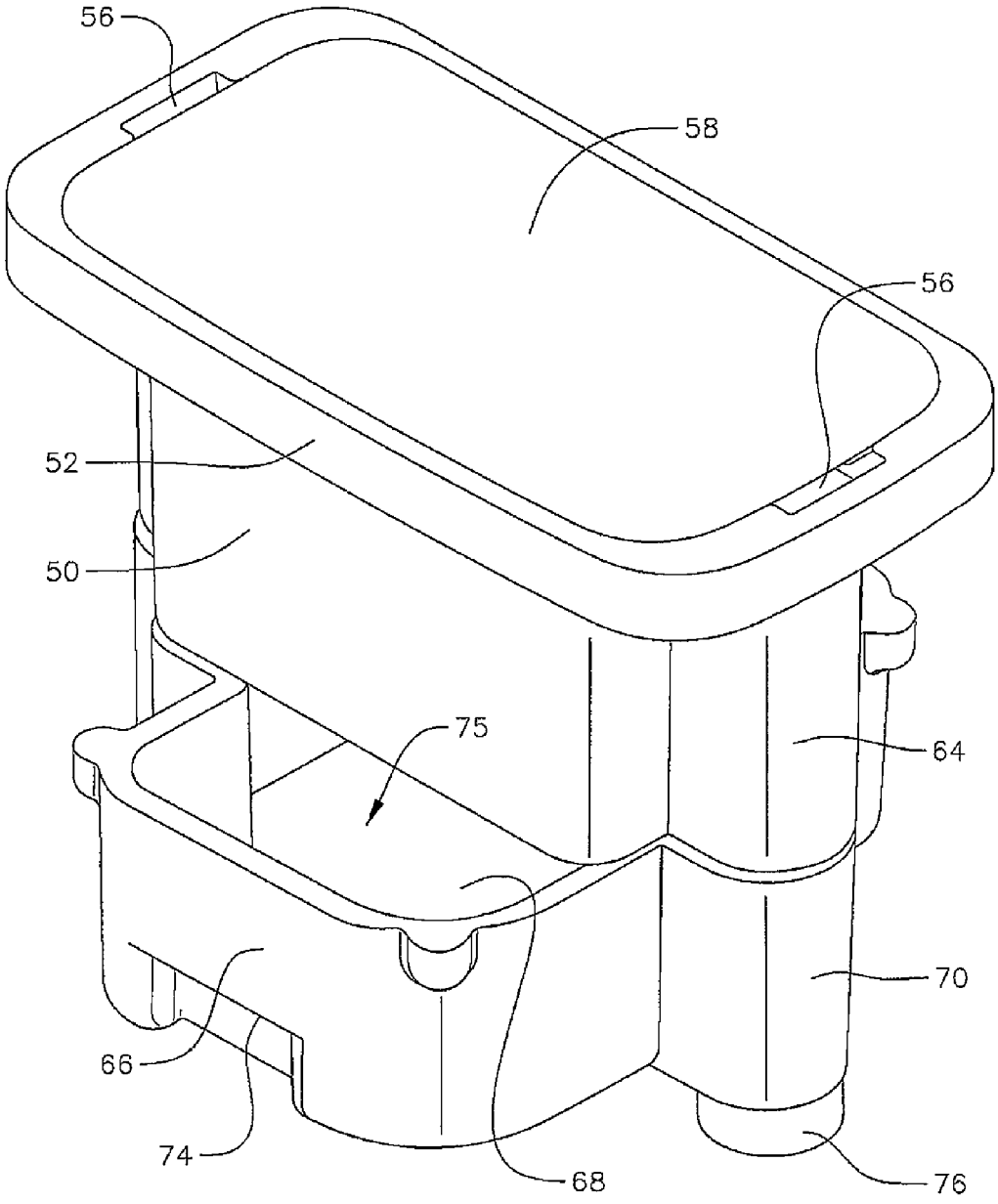
FIG. 8 is a perspective view showing an alternative embodiment of the lid-lift hole liner and containment box in an assembled configuration.
Figure 9:
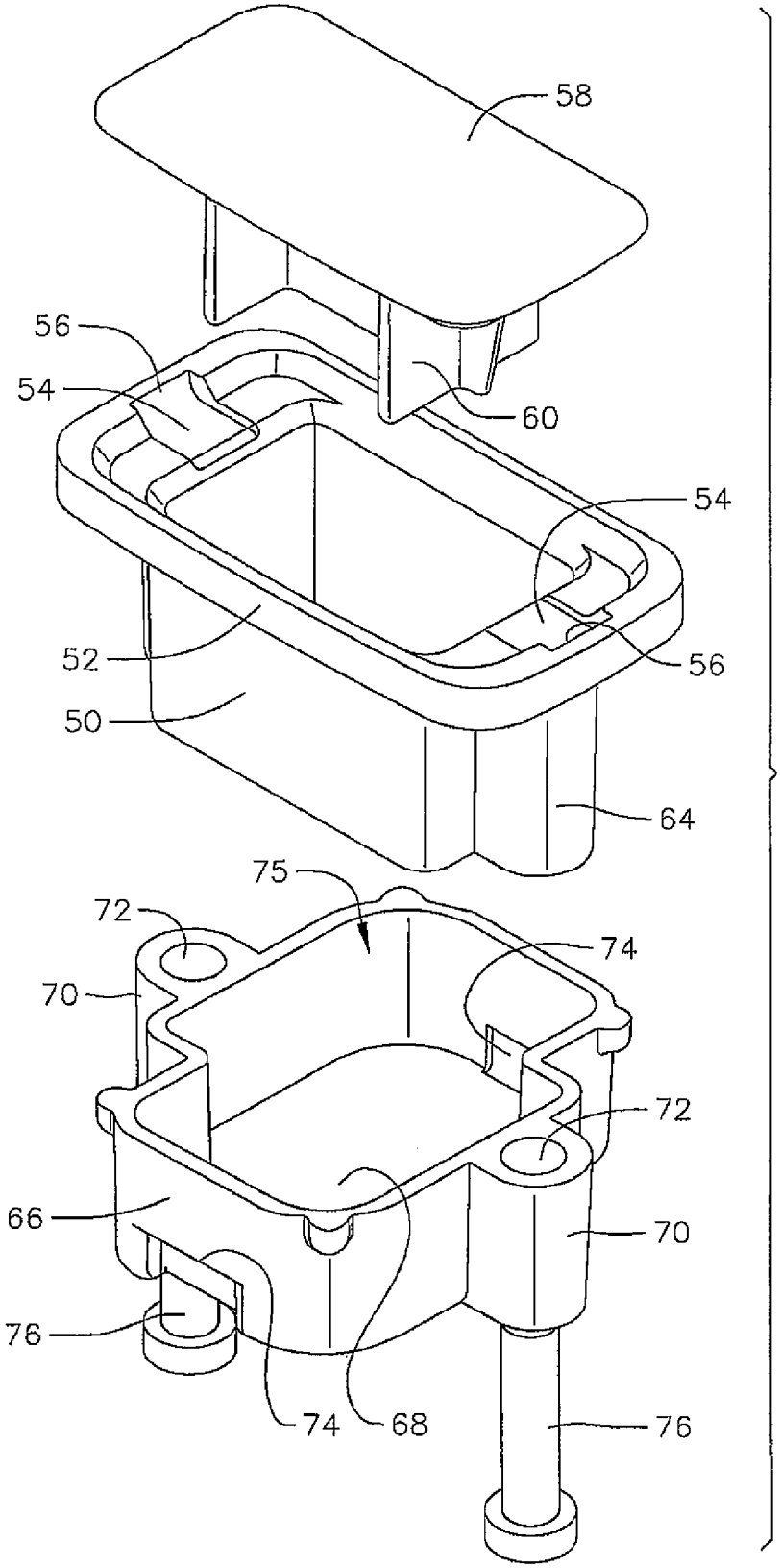
FIG. 9 is an exploded perspective view of the assembly shown in FIG. 8.

FIGS. 8 and 9 illustrate another embodiment of the invention: FIG. 8 shows the lid-lift hole liner and containment box in an assembled form and FIG. 9 shows components of the assembly. The assembly comprises a generally rectangular-shaped lid-lift hole liner 50 formed by the integral side walls and end walls of the open ended liner. An outwardly projecting rim 52 extends around the top of the liner. A pair of angled and elongated pry slots 54 are formed in recessed end regions of the rim. The pry slots face upwardly at opposite ends of the rim. The pry slots include narrow slotted openings 56 extending through a top surface of the outer rim.

A relatively thin and generally flat, rectangular-shaped cap 58 comprises a molded piece that is shaped to removably fit over the open top of the liner, inside the outer rim. A downwardly projecting profile 60 is molded to the bottom of the cap for alignment with the opening in the liner. The profile makes a snug fit inside the liner when the cap is positioned in the opening inside the top of the liner, as shown in FIG. 8. The top surfaces of the cap and the rim on the liner are flush with each other, and the pry slots 56 are exposed at the ends of the cap. The pry slots accommodate a tool for removing the cap from the liner.

The liner 50 further includes a pair of opposed elongated rounded profiles 64 molded into and projecting outwardly from opposite end walls of the liner. The profiles contain internally threaded fastener holes (similar to those shown at 34 in FIG. 1). The profiles 64 have bottom edges at or near the same level as the bottom edge around the liner.

The assembly further includes a rectangular containment box 66 having a flat bottom surface 68 and an upwardly facing open area 75 inside the side walls and end walls of the containment box. The opposite side walls of the containment box have molded elongated rounded profiles 70. Open-ended thru-holes 72 extend through the profiles 70 for alignment with the fastener holes in the liner profiles 64. The profiles 70 on the containment box have top edges at or near the level of the top edge of the box. Drain holes 74 for rain water are formed as slots in opposite end walls of the containment box next to the bottom surface of the box. The liner 50 and containment box 66 are fastened together by threaded fasteners 76 that extend through the thru-holes 72 and into the internally threaded profiles 64 on the liner.

When the liner and containment box are assembled as shown in FIG. 8, the open interior area 75 is formed below the bottom of the liner, above the bottom surface 68 of the containment box. The container box projects out away from the side walls of the liner 50, as shown best in FIG. 8, to provide an oversized area for containing debris and also for receiving the end portion of any tool used to remove the lid from its grade level position.

Figure 10:
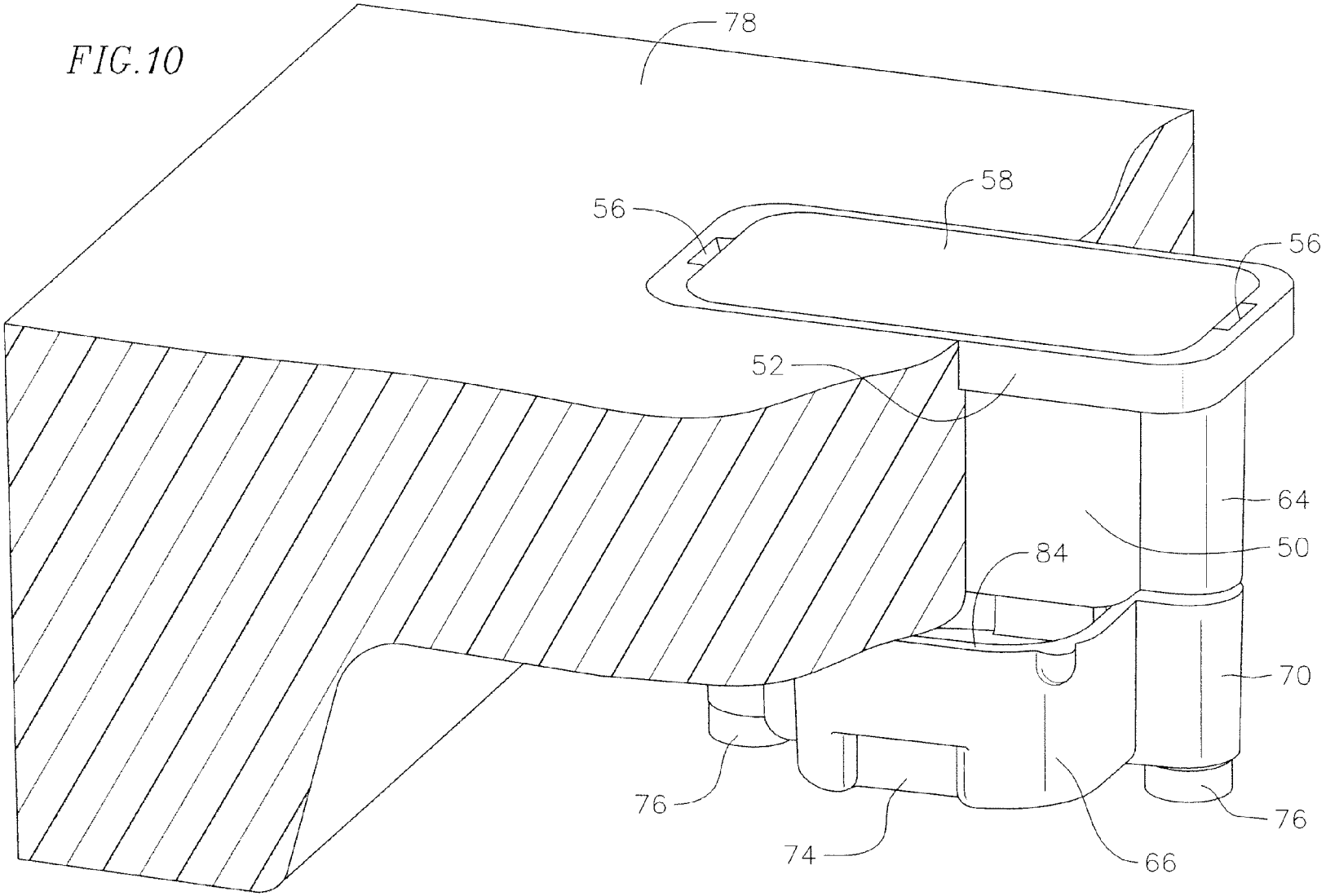
FIG. 10 is a perspective view, partly in cross-section, showing the assembly of FIGS. 8 and 9 positioned in a utility vault lid.
Figure 11:
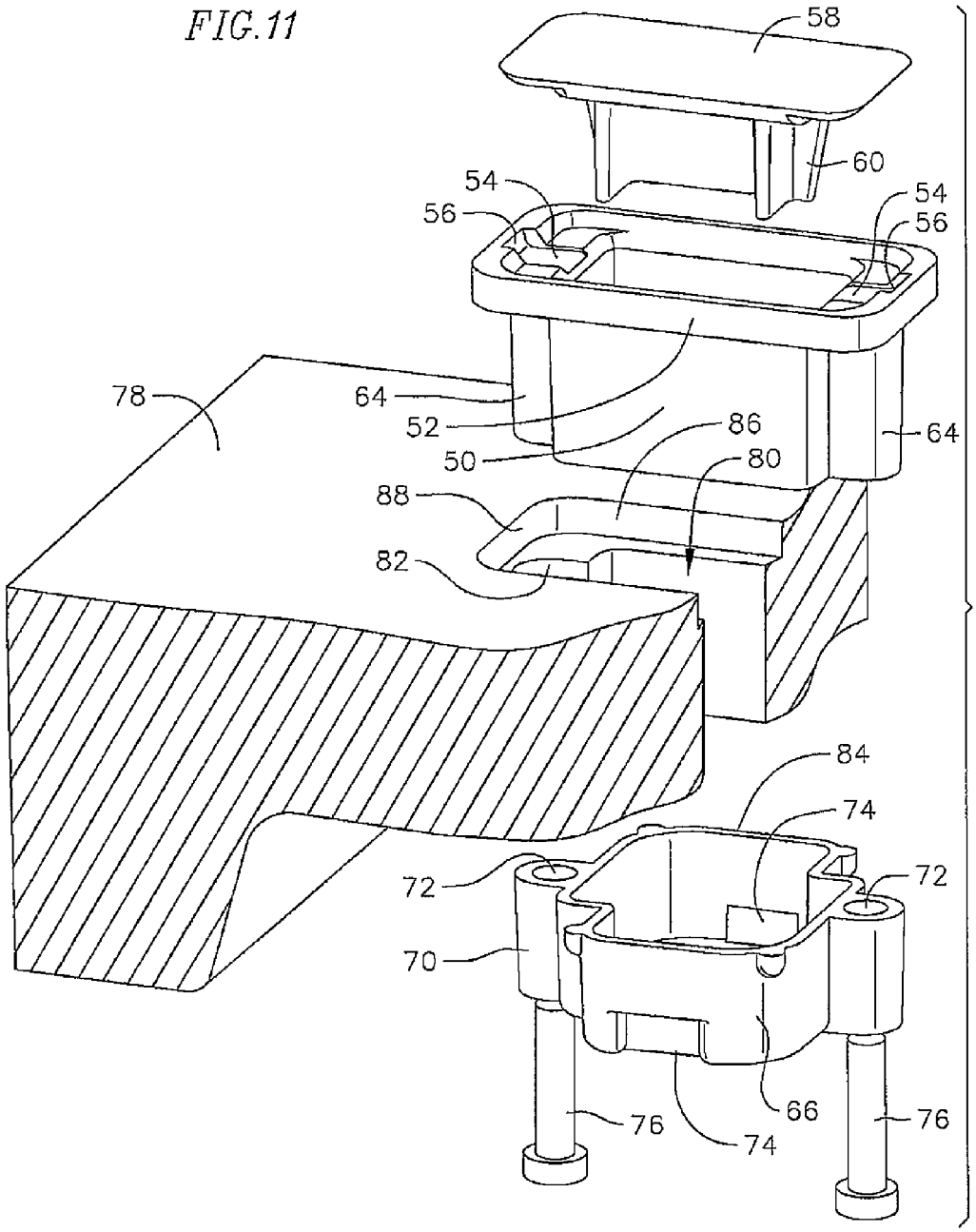
FIG. 11 is an exploded perspective view of the assembly of FIG. 10 aligned for positioning in a lid-lift hole contained in a utility vault lid.

FIGS. 10 and 11 show the assembly of FIGS. 8 and 9 positioned in a lid 78 for an underground utility vault. The lid includes an open-ended lid-lift hole 80 in which the liner 50 is positioned. The interior of the lid-lift hole can be molded to a profile at 82 that matches the end walls of the liner, including the rounded profiles 64 that contain the fasteners 76. The containment box 66 is positioned below the liner so that the top edge 84 of the box is in contact with the bottom surface of the lid. When the profiles 64 and 70 are aligned the fasteners 76 can be threaded into the profiles 64 and 70 and tightened to apply pressure between the bottom of the liner and the top of the containment box. This pressure also an be applied between contacting surfaces on the profiles 64 and 70. The outer rim 52 is disposed in a matching recessed peripheral region 86 to contact a shoulder 88 around the lid-lift hole to provide leverage for the compression force applied between the liner and the containment box when the fasteners are tightened. The applied compression force includes a compression force applied between the top edge 84 of the containment box and the bottom surface of the lid.

What is claimed is:

1. A lid-lift hole assembly for a utility vault lid that provides a removable cover for an underground utility vault, the assembly comprising a liner for an open-ended lid-lift hole passing through the lid, and a separate receptacle for positioning on the lid below the liner, in which:

the liner is adapted for positioning in the lid-lift hole in the utility vault lid, the liner having opposite side walls and opposite end walls forming an open top and an open bottom of a hollow space extending through the liner, for forming an open-ended generally tubular liner for positioning in the lid-lift hole that extends through the lid, the opposite end walls of the liner contain fastener holes for receiving fasteners, the receptacle comprises a shell having a bottom wall with upright opposite side walls and opposite end walls around the bottom wall, forming an upwardly facing hollow open space within the receptacle, the opposite side walls of the receptacle contain thru-holes for receiving fasteners, the thru-holes on the opposite side walls of the receptacle are adapted for alignment with the fastener holes in the opposite end walls of the liner, the receptacle has a larger axial dimension than the liner so that overlapping end walls and side walls of the receptacle extend beyond the side walls of the liner and are adapted for contact with the lid along a juncture between the receptacle's overlapping end walls and side walls and an underside of the lid, and the fasteners are adapted to extend through the thru-holes and into the fastener holes and can be tightened to fasten the end walls of the liner and the side walls of the receptacle to apply pressure to the juncture between the overlapping end walls and side walls of the receptacle and the underside of the lid to lock the liner in the lid-lift hole while the receptacle forms a box-like enclosure releasably held in a fixed position on the lid beneath an open passage through the hollow space from the liner into the receptacle.

2. The assembly according to claim 1 in which the bottom wall of the receptacle includes drainage holes.

3. The assembly according to claim 1 including a peripheral rim on the liner adapted for positioning on an upper surface of the lid.

4. The assembly according to claim 1 in which the assembly further comprises an underground utility vault containing communications equipment stored underground in the vault, and the lid comprises the removable cover for the vault.

5. A utility vault lid that provides a removable cover for an underground utility vault, the lid having an open-ended lid-lift hole which includes an assembly comprising a liner for the lid-lift hole and a separate receptacle positioned on the lid below the liner, in which:

the liner is positioned in the lid-lift hole in the utility vault lid, the liner having opposite side walls and opposite end walls forming an open top and an open bottom of a hollow space extending through the liner, thereby forming an open-ended generally tubular lined lid-lift hole that passes through the lid, the opposite end walls of the liner contain fastener holes for receiving fasteners, the receptacle has a bottom wall with upright opposite side walls and opposite end walls around the bottom wall forming an upwardly facing hollow open space within the receptacle, the opposite side walls of the receptacle contain thru-holes for receiving fasteners, the thru-holes on the opposite side walls of the receptacle are aligned with the fastener holes in the opposite end walls of the liner, the receptacle has a larger axial dimension than the liner so that overlapping end walls and side walls of the receptacle extend beyond the side walls of the liner and contact the lid along a juncture between the receptacle's overlapping end walls and side walls and the underside of the lid, and the fasteners extend through the thru-holes and into the fastener holes and are tightened to fasten the end walls of the liner and the side walls of the receptacle to apply pressure to the juncture between the overlapping end walls and side walls of the receptacle and the underside of the lid to lock the liner in the lid-lift hole while the receptacle forms a box-like enclosure releasably held in a fixed position on the lid beneath an open passage through the hollow space from the liner into the receptacle.

6. The utility vault lid according to claim 5 in which the bottom wall of the receptacle includes drainage holes.

7. The utility vault lid according to claim 5 including a peripheral rim on the liner positioned on an upper surface of the lid.

8. The utility vault lid according to claim 5 including a removable cap in an upper portion of the liner.

9. An assembly which comprises the utility vault lid of claim 5 providing the removable cover for an underground vault containing communications equipment stored underground in the vault.

* * * * *